US006999496B2

(12) United States Patent
Fishman et al.

(10) Patent No.: US 6,999,496 B2
(45) **Date of Patent: *Feb. 14, 2006**

(54) HIGH EFFICIENCY INDUCTION HEATING AND MELTING SYSTEMS

(75) Inventors: Oleg S. Fishman, Maple Glen, PA (US); Bernard M. Raffner, Moorestown, NJ (US)

(73) Assignee: Inductotherm Corp., Rancocas, NJ (US)

( * ) Notice: Subject to any disclaimer, the term of this patent is extended or adjusted under 35 U.S.C. 154(b) by 12 days.

This patent is subject to a terminal disclaimer.

(21) Appl. No.: 10/771,476

(22) Filed: Feb. 4, 2004

(65) Prior Publication Data

US 2004/0233965 A1 Nov. 25, 2004

Related U.S. Application Data

(63) Continuation-in-part of application No. 10/135,271, filed on Apr. 29, 2002, now Pat. No. 6,690,710, which is a continuation-in-part of application No. 09/550,305, filed on Apr. 14, 2000, now Pat. No. 6,393,044.

(60) Provisional application No. 60/165,304, filed on Nov. 12, 1999.

(51) Int. Cl.
*H05B 6/02* (2006.01)

(52) U.S. Cl. ..... 373/138; 373/152; 373/160; 219/672

(58) Field of Classification Search ..... 373/7, 373/138–139, 151–164; 75/10.14; 266/44, 266/275, 280; 219/600, 635, 647, 653, 672; 432/156, 248

See application file for complete search history.

(56) References Cited

U.S. PATENT DOCUMENTS

| | | | | |
|---|---|---|---|---|
| 4,330,698 | A * | 5/1982 | Sawada et al. | 219/696 |
| 5,425,047 | A * | 6/1995 | Betz et al. | 373/143 |
| 6,101,212 | A * | 8/2000 | Hugo et al. | 373/156 |
| 6,393,044 | B1 * | 5/2002 | Fishman et al. | 373/138 |
| 6,690,710 | B1 * | 2/2004 | Fishman et al. | 373/138 |

* cited by examiner

*Primary Examiner*—Tu Hoang
(74) *Attorney, Agent, or Firm*—Philip O. Post

(57) ABSTRACT

An induction heating and melting system uses a crucible formed from a material that has a high electrical resistivity or high magnetic permeability, and one or more inductor coils formed from a wound cable consisting of multiple individually insulated copper conductors to form an induction furnace that, along with its associated power supply, provides a compact design. The system components are air-cooled; no water-cooling is required. The crucible may alternatively be shaped as a tunnel or enclosed furnace.

20 Claims, 14 Drawing Sheets

HIGH EFFICIENCY INDUCTION HEATING AND MELTING SYSTEMS

CROSS-REFERENCE TO RELATED APPLICATIONS

This application is a continuation-in-part of U.S. application Ser. No. 10/135,271, filed Apr. 29, 2002 now U.S. Pat. No. 6,690,710, which is a continuation-in-part of application Ser. No. 09/550,305, filed Apr. 14, 2000, now U.S. Pat. No. 6,393,044 and also claims priority to provisional patent application Ser. No. 60/165,304, filed Nov. 12, 1999, the entirety of each of which are incorporated herein by reference.

FIELD OF THE INVENTION

The present invention relates to induction heating and melting systems that use magnetic induction to heat a crucible in which metal or other materials can be heated and/or, melted and held in the molten state by heat transfer from the crucible.

BACKGROUND OF THE INVENTION

Induction melting systems gain popularity as the most environmentally clean and reasonably efficient method of melting metal. In the induction melting furnace 1 shown in FIG. 1, the electromagnetic field produced by AC current in coil 2 surrounding a crucible 3 couples with metal or other conductive materials 4 inside the crucible and induces eddy currents 5, which in turn heat the metal. As indicated in FIG. 1, the arrows associated with coil 2 generally represent the direction of current flow in the coil, whereas the arrows associated with eddy currents 5 generally indicate the opposing direction of induced current flow in the conductive materials. Variable high frequency ac (typically in the range from 100 to 10,000 Hz) current is generated in a power supply or in a power converter 6 and supplied to coil 2. The converter 6, typically but not necessarily, consists of an AC-to-DC rectifier 7, a DC-to-AC inverter 8, and a set of capacitors 9, which, together with the induction coil, form a resonant loop. Other forms of power supplies, including motors-generators, pulse-width modulated (PWM) inverters, and the like, can be used.

As shown in FIG. 2, the magnetic field causes load current 10 to flow on the outside cylindrical surface of the conductive material, and coil current 11 to flow on the inner surface of the coil conductor. Crucible 3 in a typical furnace is made from ceramic material and usually is not electrically conductive. The efficiency of the furnace is computed by the formula:

$$\eta = \frac{1}{1 + \frac{D_1}{D_2} \cdot \frac{\rho_1}{\rho_2} \cdot \frac{\Delta_2}{\Delta_1}} \qquad \text{equation (1)}$$

where $\eta$=furnace efficiency;

$D_1$=coil inner diameter;

$D_2$=load outer diameter;

$\rho_1$=resistivity of coil winding material (copper);

$\rho_2$=resistivity of load (melt);

$\Delta_1$=current depth of penetration in copper winding; and $\Delta_2$=current depth of penetration in load (melt).

The depth of current penetration ($\Delta$) is a function of a material's properties as determined by the formula:

$$\Delta = k \cdot \sqrt{\frac{\rho}{f \cdot \mu}} \qquad \text{equation (2)}$$

where:

$\rho$=resistivity in ohm·meters;

f=frequency in Hertz;

$\mu$=magnetic permeability (dimensionless relative value); and $\Delta$=depth of penetration in meters.

The constant, k=503, in equation (2) is dimensionless.

Because current does not penetrate deep into the low resistivity copper material of the coil, the typical coil efficiency is about 80 percent when the molten material is iron. Furnaces melting low resistivity materials such as aluminum (with a typical resistivity value of $2.6\times10^{-8}$ ohm·meters), magnesium or copper alloys have a lower efficiency of about 65 percent. Because of significant heating due to electrical losses, the induction coil is water-cooled. That is, the coil is made of copper tubes 12 and a water-based coolant is passed through these tubes. The presence of water represents an additional danger when melting aluminum, magnesium or their alloys. In case of crucible rupture, water may combine with molten aluminum and a violent chemical reaction may take place in which the aluminum combines with oxygen in the water, releasing free hydrogen which may cause an explosion. Contact between water and magnesium may similarly result in an explosion and fire. Extreme caution is taken when aluminum or magnesium is melted in conventional water-cooled furnaces.

An object of the present invention is to improve the efficiency of an induction furnace by increasing the resistance of the load by using as the load a crucible made of a high temperature electrically conductive material or a high temperature material with high magnetic permeability. It is another object of the present invention to improve the efficiency of an induction furnace by reducing the resistance of the induction coil by using as the coil a cable wound of multiple copper conductors that are isolated from each other. It is still another object of the invention to properly select operating frequencies to yield optimum efficiency of an induction furnace.

It is a further object of the present invention to provide a high efficiency induction melting system with a furnace and power supply that do not use water-cooling and can be efficiently air-cooled.

SUMMARY OF THE INVENTION

In its broad aspects, the present invention is an induction furnace that is used for melting a metal charge. The furnace has a crucible formed substantially from a material having a high electrical resistivity or high magnetic permeability, preferably a silicon carbide or a high permeability steel. At least one induction coil surrounds the crucible. The coil consists of a cable wound of a plurality of conductors isolated one from the other. An isolation sleeve electrically and thermally insulates the crucible from the at least one induction coil. Preferably, the isolation sleeve is a composite ceramic material, such as an air-bubbled ceramic between two layers of ceramic. In alternate examples of the invention, the induction furnace is used to heat the metal charge to a temperature that may be below its melting point.

Copper is especially preferred for the conductors, because of its combination of reasonably high electrical conductivity and reasonably high melting point. A preferred form of the cable is Litz wire or litzendraht, in which the individual isolated conductors are woven together in such a way that each conductor successively takes all possible positions in the cross section of the cable, so as to minimize skin effect and high-frequency resistance, and to distribute the electrical power evenly among the conductors.

In another aspect, the present invention is an induction melting system that is used for melting a metal charge. The system has at least one power supply. The crucible that holds the metal charge is formed substantially from a material having a high electrical resistivity or high magnetic permeability, preferably a silicon carbide or a high permeability steel. At least one induction coil surrounds the crucible. The coil consists of a cable wound of a large number of copper conductors isolated one from the other. An isolation sleeve electrically and thermally insulates the crucible from the at least one induction coil. Preferably, the isolation sleeve is a composite ceramic material, such as an air-bubbled ceramic between two layers of ceramic. Preferably, the induction melting system is air-cooled from a single source of air that sequentially cools components of the power supply and the coil. The metal charge is placed in the crucible. Current is supplied from the at least one power supply to the at least one coil to heat the crucible inductively. Heat is transferred by conduction and/or radiation from the crucible to the metal charge, and melts the charge. In alternate examples of the invention, the induction furnace is used to heat the metal charge to a temperature that may be below its melting point.

In another aspect, the present invention is an induction heating system that is used to heat, melt, vaporize, and/or otherwise alter the physical state of a workpiece or material by heating. The system has at least one power supply. The crucible that holds the workpiece or material is formed substantially from a material having a high electrical resistivity or high magnetic permeability, preferably a silicon carbide or a high permeability steel. At least one induction coil surrounds the crucible. The coil consists of a cable wound of a large number of copper conductors isolated one from the other. An isolation sleeve electrically and thermally insulates the crucible from the at least one induction coil. Preferably, the isolation sleeve is a composite ceramic material, such as an air-bubbled ceramic between two layers of ceramic. Preferably, the induction melting system is air-cooled from a single source of air that sequentially cools components of the power supply and the coil. The workpiece or material is placed in the crucible. Current is supplied from the at least one power supply to the at least one coil to heat the crucible inductively. Heat is transferred by conduction and/or radiation from the crucible to the workpiece or material in the crucible, and heats, melts, vaporizes and/or otherwise alters the physical state of the workpiece or charge by the conducted and/or radiated heat.

These and other aspects of the invention will be apparent from the following description and the appended claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4(*b*) is a cross sectional view of the wound cable shown in FIG. 4(*a*).

FIG. 4(*c*) is a cross sectional view of one of the insulated copper conductors that make up the wound cable.

FIG. 5(*b*) is a cross sectional detail of one embodiment of the isolation sleeve shown in FIG. 5(*a*).

FIG. 5(*c*) illustrates the airflow through the power supply and induction coil for the induction melting or heating systems of the present invention.

FIG. 11(*b*) is a perspective view of another induction tunnel heating system of the present invention.

FIG. 11(*c*) is a perspective view of another induction tunnel heating system of the present invention.

DETAILED DESCRIPTION OF THE INVENTION

Figure 3:
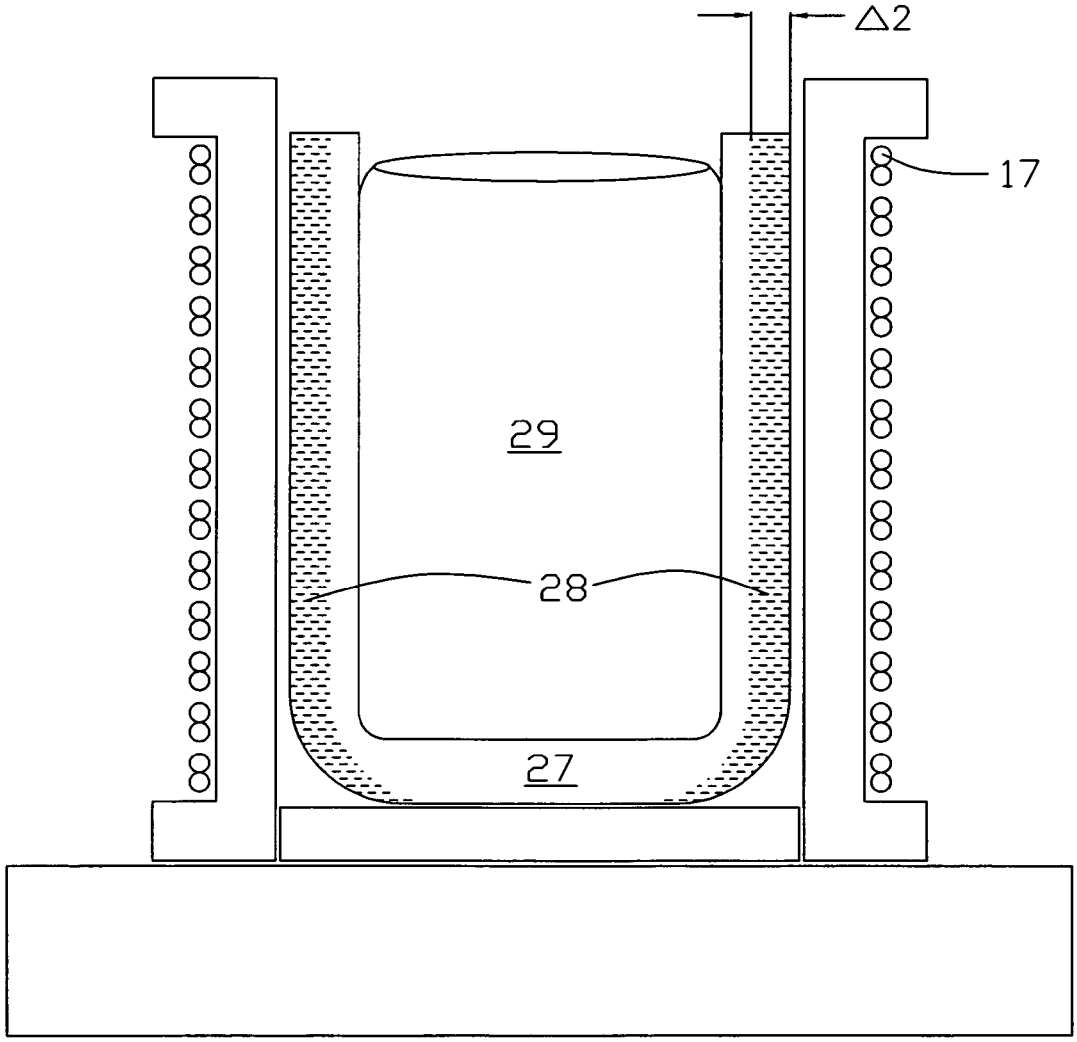
FIG. 3 is a cross sectional elevation view showing the distribution of current in an electrically conductive high resistance crucible used in the induction furnace of the present invention.

The efficiency of an induction furnace as expressed by equation (1) and equation (2) above, can be improved if the resistance of the load can be increased. The load resistance in furnaces melting highly conductive metals such as aluminum, magnesium or copper alloys, may be increased by coupling the electromagnetic field to the crucible instead of to the metal itself. The ceramic crucible may be replaced by a high temperature, electrically conductive material with high resistivity factor. Silicon carbide (SiC) is one of the materials that has these properties, namely a resistivity generally in the range of 10 to $10^4$ ohm·meters. Silicon carbide compositions with resistivity in the approximate range of 3,000 to 4,000 ohm·meters are particularly applicable to the present invention. Alternatively, the crucible may be made from steel. For example, there are high permeability ferromagnetic steels with relative permeabilities in the range of 5,000. In this case, rather than relying on high resistivity, the high permeability will result in low depth of current penetration. As the steel is heated its permeability will drop. FIG. 3 shows the distribution of current 28 in the crucible 27 that will produce the effect of high total resistance. The best effect is achieved when the wall thickness of the crucible is about 1.3 to 1.5 times larger than the depth of current penetration into the crucible. In this case, the shunting effect of highly conductive molten metal 29 is minimized.

Figure 1:
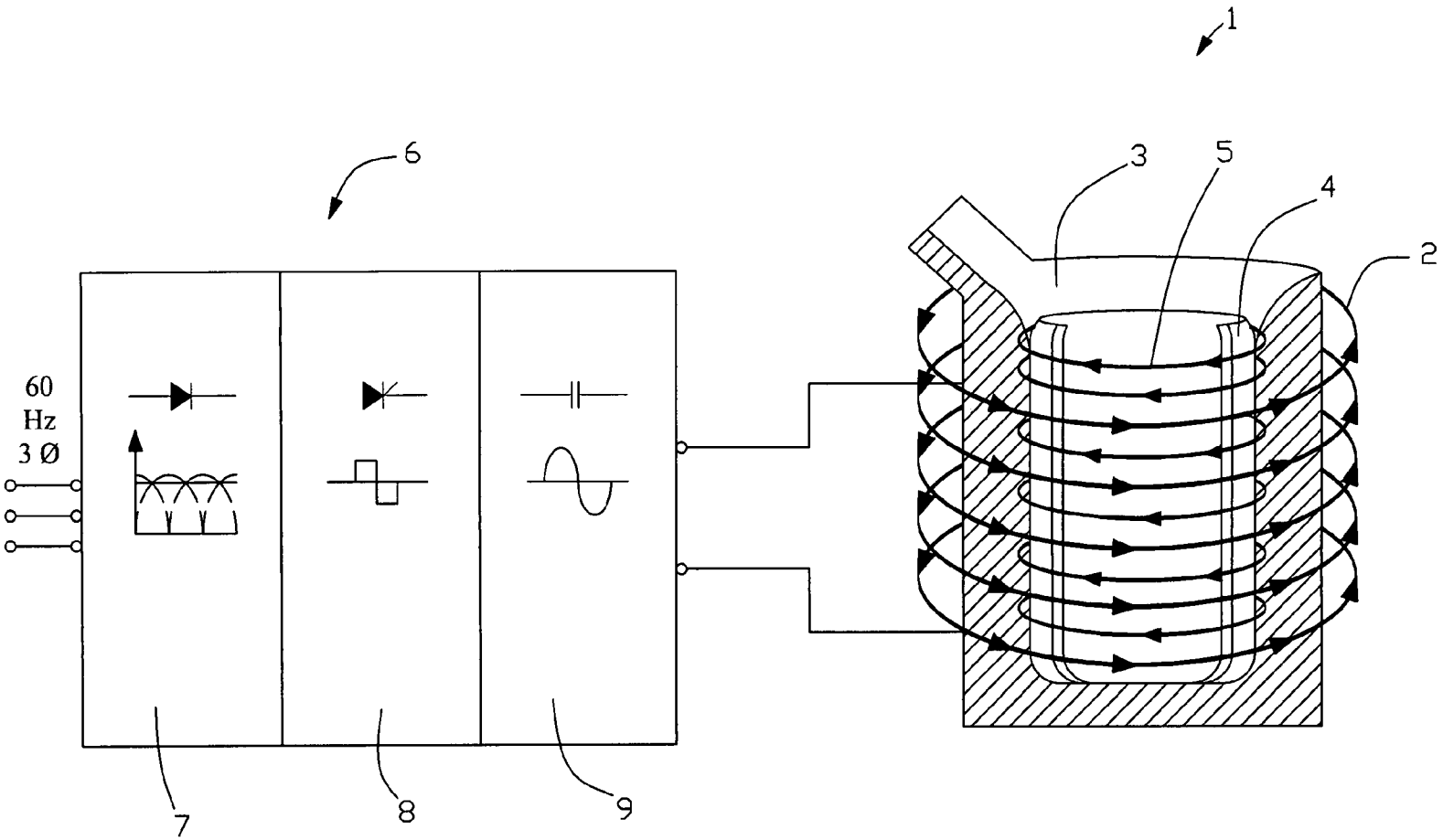
FIG. 1 PRIOR ART
FIG. 1 is a diagrammatic representation of a prior art induction melting system that includes a furnace and power supply converter.
Figure 2:
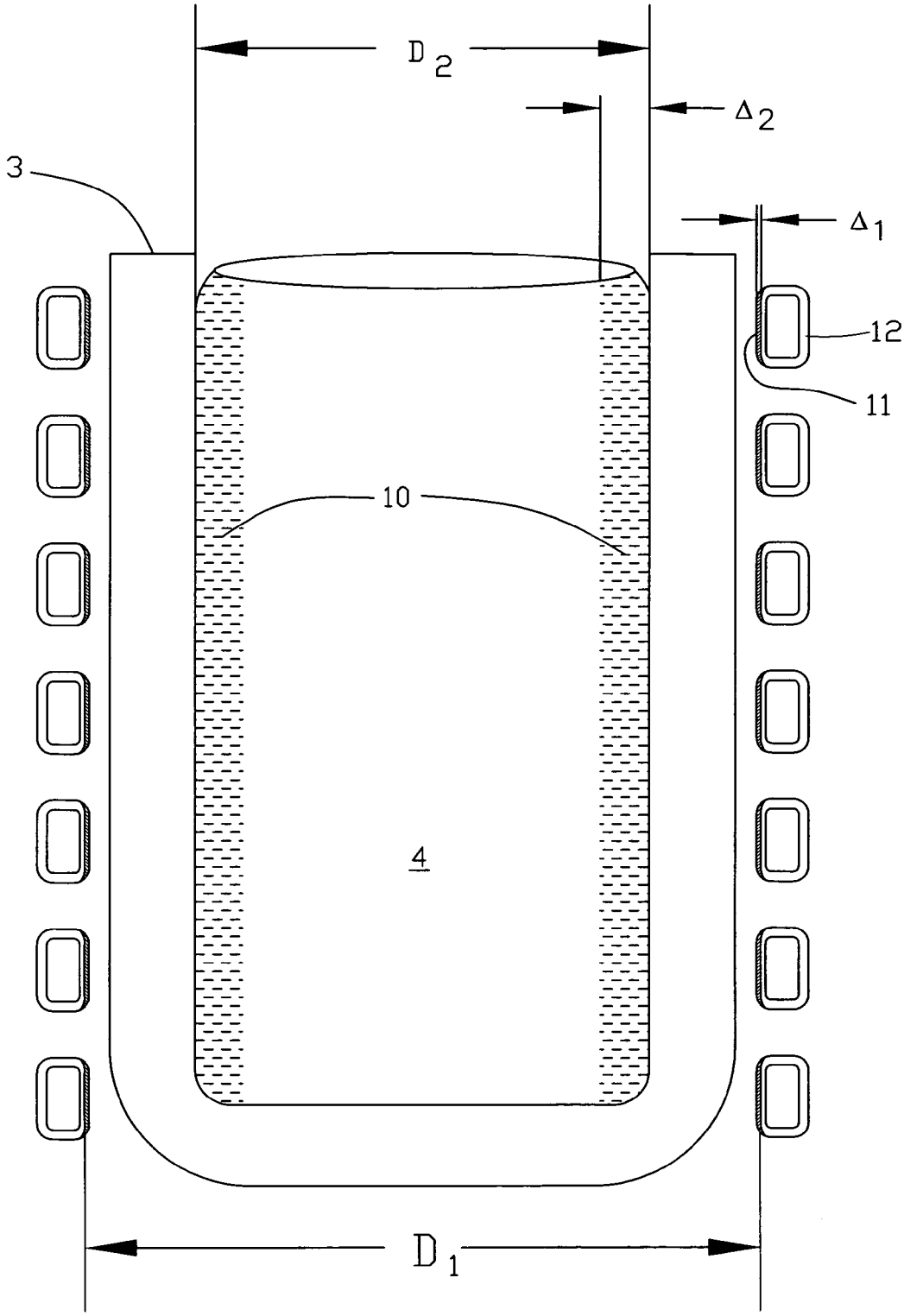
FIG. 2 PRIOR ART
FIG. 2 is a cross sectional elevation view of a prior art induction coil of copper tubes around a crucible that has a conductive material inside of the crucible.
Figure 4A:
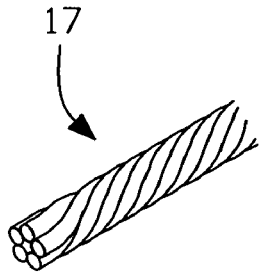
FIG. 4(*a*) is a perspective view of a wound cable composed of twisted multiple copper conductors that is used in the induction furnace of the present invention.
Figure 4C:
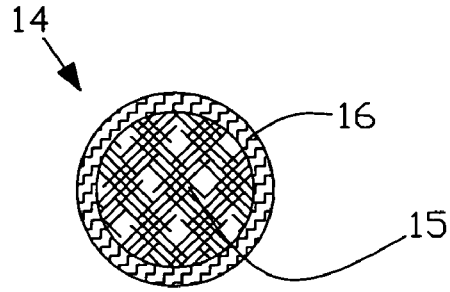
Figure 4B:
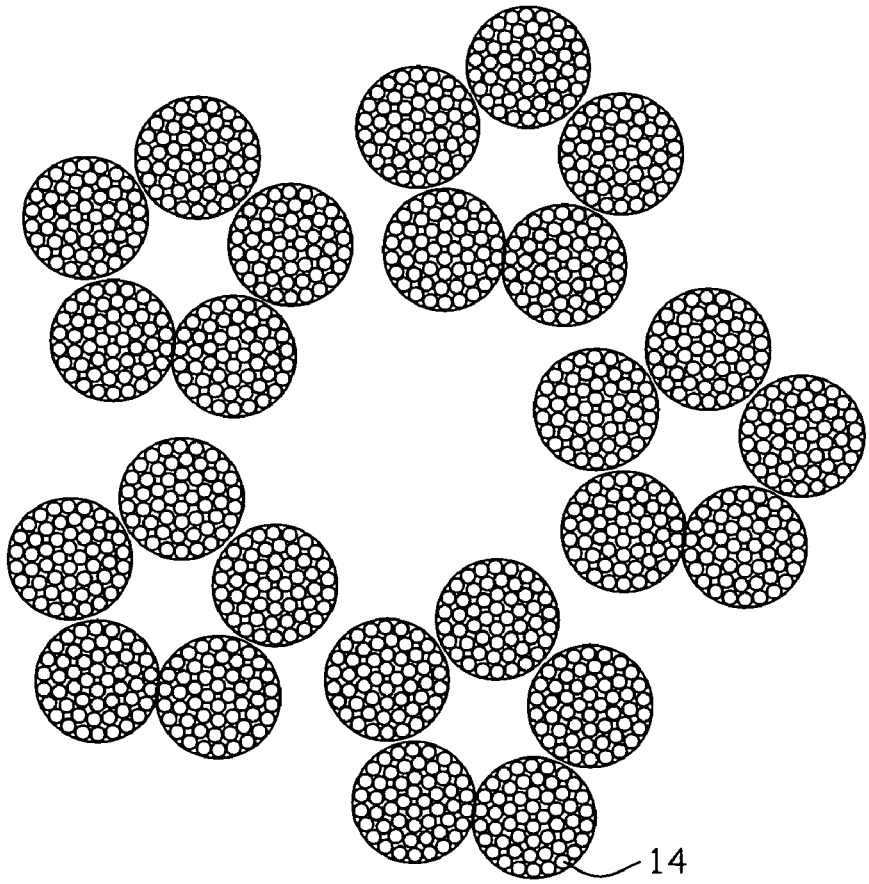

An additional improvement in the efficiency of an induction furnace can be achieved by reducing the resistance of the coil. High conductivity copper is widely used as the material for a coil winding. However, because of the high conductivity (low resistivity) of the copper, the current is concentrated in a thin layer of coil current 11 on the surface of the coil facing the load, as shown in FIG. 2. The depth of current penetration is given by equation (2). Because the layer is so thin, especially at elevated frequencies, the effective coil resistance may be considerably higher than would be expected from the resistivity of copper and the total cross-sectional area of the copper coil. That will significantly affect the efficiency of the furnace. Instead of using a solid tubular conductor, one embodiment of the present invention uses a cable 17 wound of a large number of copper conductors isolated one from another, as shown in FIGS. 4(*a*), 4(*b*) and 4(*c*). One of the insulated copper conductors 14 is shown in FIG. 4(*c*) with the insulation 16 that isolates the copper conductor 15 from surrounding conductors. The cable 17 is of the sort known in the electronic industry as Litz wire or litzendraht. It assures equal current distribution through the copper cross section when the diameter of each individual copper wire strand is significantly smaller than the depth of current penetration $\Delta_1$ as given by equation (2). For the present application, a suitable but not limiting number of strands is approximately between 1,000 and 2,000. Other variations in the configuration of the Litz wire will perform satisfactory without deviating from the present invention.

The proper selection of operating frequencies yields optimum efficiency of an induction furnace. The criteria for frequency selection are based on depth of current penetration in the high resistance crucible and copper coil. The two criteria are:

$$\Delta_1 >> d_1; \text{ and}$$

$$\Delta_2 \approx 1.2 \cdot d_2$$

where:

$d_1$=diameter of a strand of Litz wire; and $d_2$=wall thickness of the crucible.

For example, when the copper strand diameter is $d_1$=0.01 inch and the silicon carbide wall thickness is $d_2$=2.0 inches, the optimal frequency is 3,000 Hz. With this selection, the relative electrical losses in the coil may be reduced to about 2.2%, which is more than 15 times better than a standard induction furnace.

Acceptable, but not limiting, parameters for a furnace in accordance with the present invention is selecting $d_1$ in the range of 0.2 to 2.0 meters, $d_2$ in the range of 0.15 to 1.8 meters, and frequency in the range of 1,000 to 5,000 Hertz.

Such an increase in efficiency or reduction in coil losses, and thus reduction in heating of the coil, eliminates the need for a water-based cooling system. Instead, a reasonable airflow through the induction coil is sufficient to remove the heat generated by the coil. The furnace crucible should be well insulated from the coil to minimize thermal losses and heating of the copper winding due to thermal conduction.

Figures 5A, 5B:
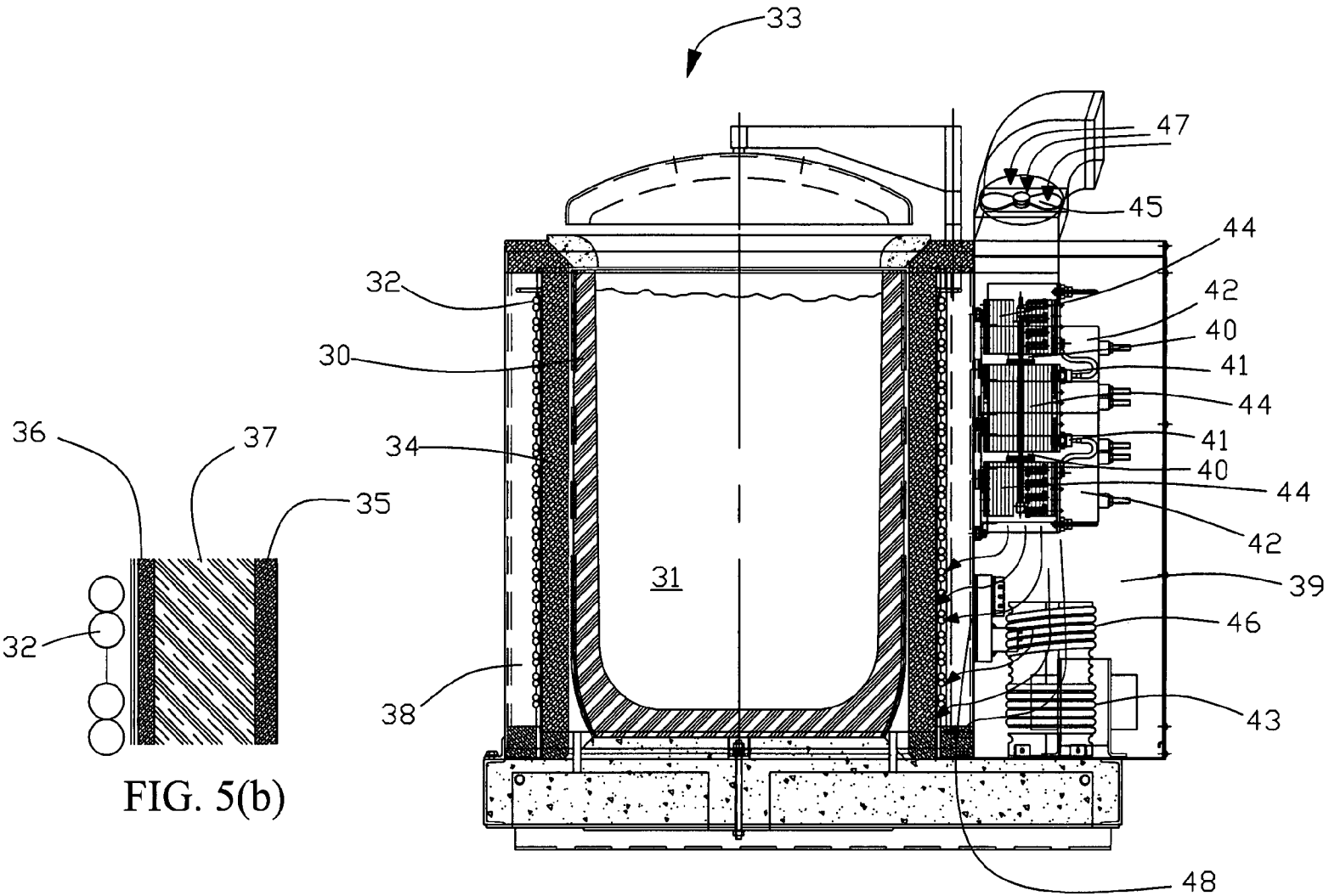
FIG. 5(*a*) is a cross sectional elevation view of an induction furnace of the present invention with a high electrical resistance crucible and an induction coil of the wound cable shown in FIG. 4(*b*).
Figure 5C:
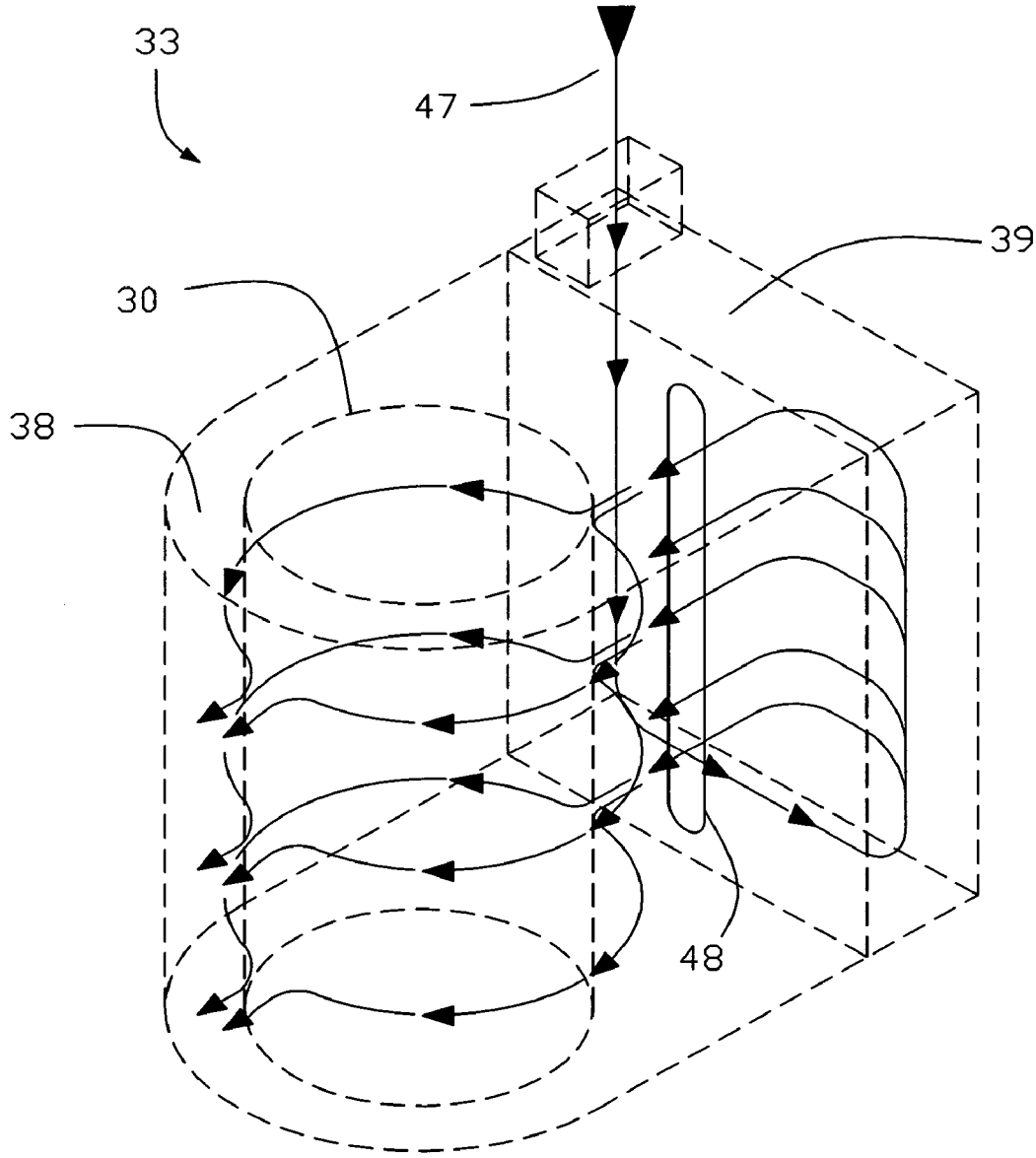

Referring now to the drawings, wherein like numerals indicate like elements, there is shown in FIG. 5(*a*) an embodiment of a high-efficiency induction melting system 33 in accordance with the present invention. The induction melting system 33 includes a high electrical resistance or high magnetic permeance crucible 30 containing metal charge 31. The high resistance or high permeance is achieved by using a crucible made from a high resistivity material ($\rho$>2500 $\mu\Omega\cdot$cm) like silicon carbide or from a high permeability steel ($\mu$>20), respectively. The selection of crucible material depends on the properties of the metals to be melted. For aluminum or copper alloys, silicon carbide is a better crucible material, while for magnesium or magnesium alloys, steel may be a better choice for the crucible material. The crucible 30 is heated by the magnetic field generated by current in the coil 32, which is made with Litz wire. The hot crucible is insulated from the coil electrically and thermally by an isolation sleeve 34. The isolation sleeve is constructed from a high strength composite ceramic material containing one or more inner layers 35 and outer layers 36 filled with air-bubbled ceramic 37 with good thermal insulation properties. The honeycomb structure of the isolation sleeve provides necessary strength and thermal isolation. The electrically insulating nature of the isolation sleeve, together with its low magnetic permeability, ensures that no appreciable inductive heating takes place in the isolation sleeve itself. That concentrates the heating in the crucible 30, inside the thermal insulation of the isolation sleeve 34, which both improves the efficiency of the induction melting system 33 and reduces heating of the coil 32.

Figure 6:
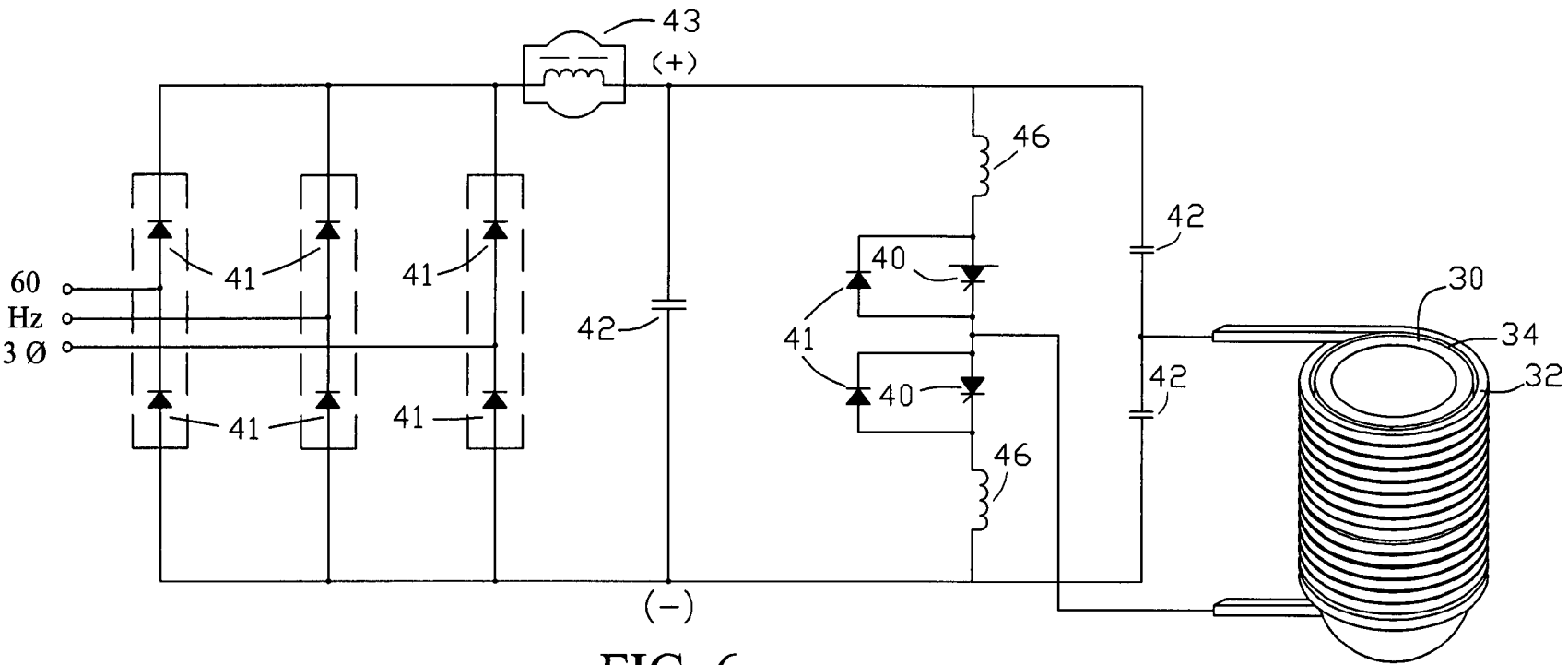
FIG. 6 is an electrical schematic of the power circuit for one embodiment of the induction melting or heating systems of the present invention.

One embodiment of the invention includes a power converter 39 that converts a three-phase standard line voltage such as 220, 280 or 600 volts into a single phase voltage with a frequency in the range of 1,000 to 3,000 Hz. The power converter may include power semiconductor diodes 41, silicon controlled rectifiers (SCR) 40, capacitors 42, inductors 43 and 46, and control electronics. The schematic diagram of one implementation of the power converter is shown in FIG. 6. In FIG. 6, diodes 41 in the rectifier bridge are optionally provided in dual-diode modules. Inductor 43 serves as a choke, and inductors 46 are di/dt reactors. SCRs 40 and associated anti-parallel diodes 41 are suitably connected to heat sinks. All of the semiconductor components of the power converter are air-cooled via heat exchangers 44 (shown in FIG. 5(*a*)), such as heat sinks. Other inverter circuits and/or electromechanical systems can be used.

In one embodiment of the invention, the power converter 39 is mounted adjacent to the induction coil 32. As shown in FIG. 5(*a*) and FIG. 5(*c*), an airflow 47 (as illustrated by arrows from an external blower 45) is fed to the power converter where the cold air first cools the semiconductors' heat exchangers 44, and then the capacitors, inductors and other passive components. The converter cabinet is positively pressurized to prevent dust and other particulate from entering the electronics compartments. The airflow exits through a slot 48 in the back wall of the power supply 39, and enters and flows through the coil chamber 38 to remove heat from the coil. In FIG. 5(*c*), for clarity in illustrating the airflow 47 through the induction melting system, the induction melting system 33 is outlined in phantom.

Figure 7:
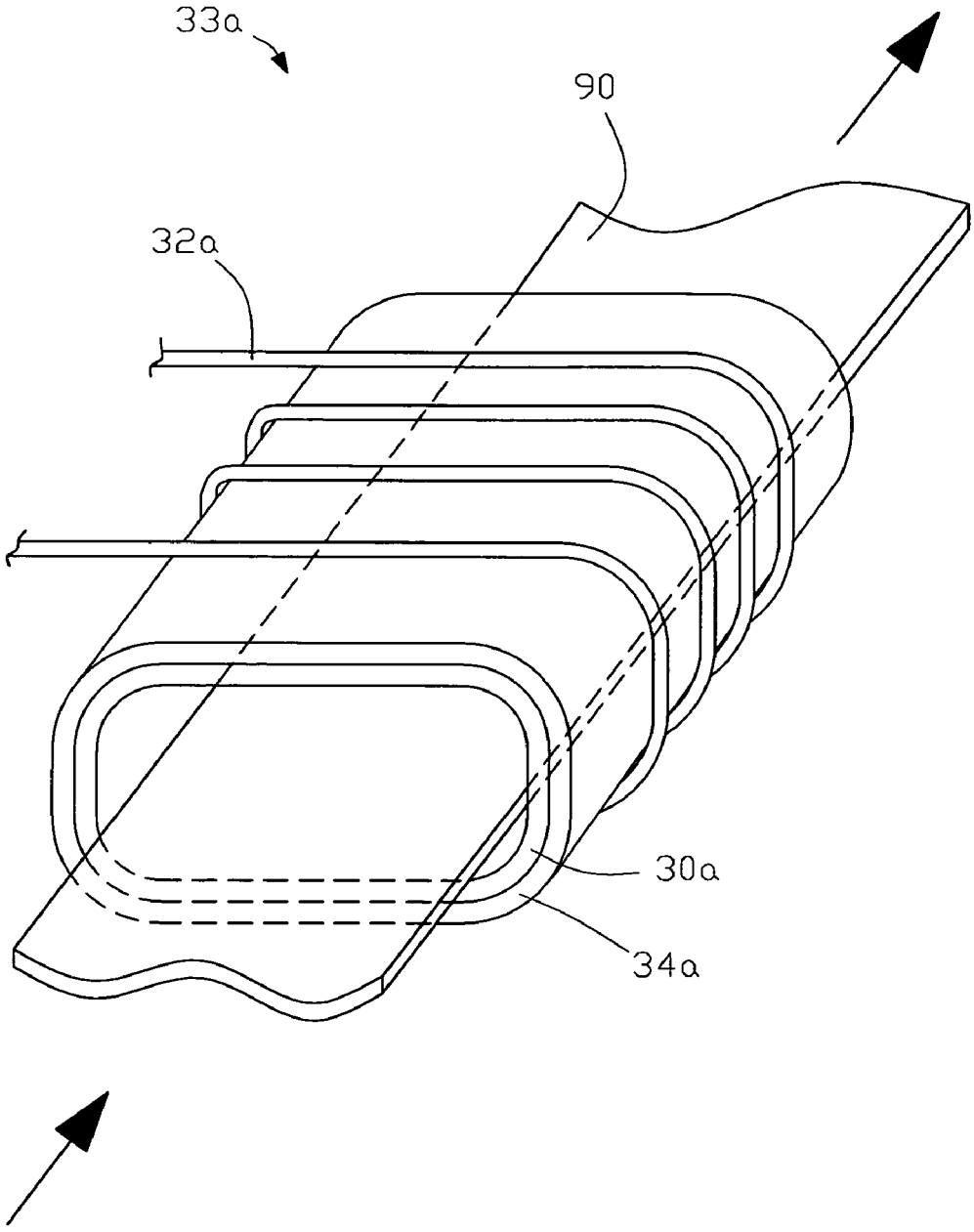
FIG. 7 is a perspective view of an induction tunnel heating system of the present invention for heating a workpiece.

In an alternative embodiment as shown in FIG. 7, a high-efficiency induction heating system 33*a* in accordance with the present invention, is in the form of a tunnel furnace through which multiple discrete workpieces, or a continuous workpiece 90, such as a metal strip, wire or other object to be heated, can be run through the furnace by a mechanical conveying system (not shown in the drawing) in the direction indicated by the arrows. In this embodiment, the furnace tunnel crucible 30*a*, is surrounded by isolation sleeve 34*a*. Coil 32*a* is coiled around the exterior of isolation sleeve 34*a* and connected to a suitable power supply converter (not shown in FIG. 7). Crucible 30*a*, isolation sleeve 34*a*, coil 32*a* and the power supply converter are similar to crucible 30, isolation sleeve 34, coil 32, and power converter 39 disclosed in other examples of the invention. Ac current supplied from the power converter to the coil that comprises a cable wound of a plurality of conductors isolated from each other will generate a magnetic field that inductively heats the crucible. Heat generated in the crucible will conduct into the tunnel of the furnace and heat workpieces within the tunnel.

Figure 8:
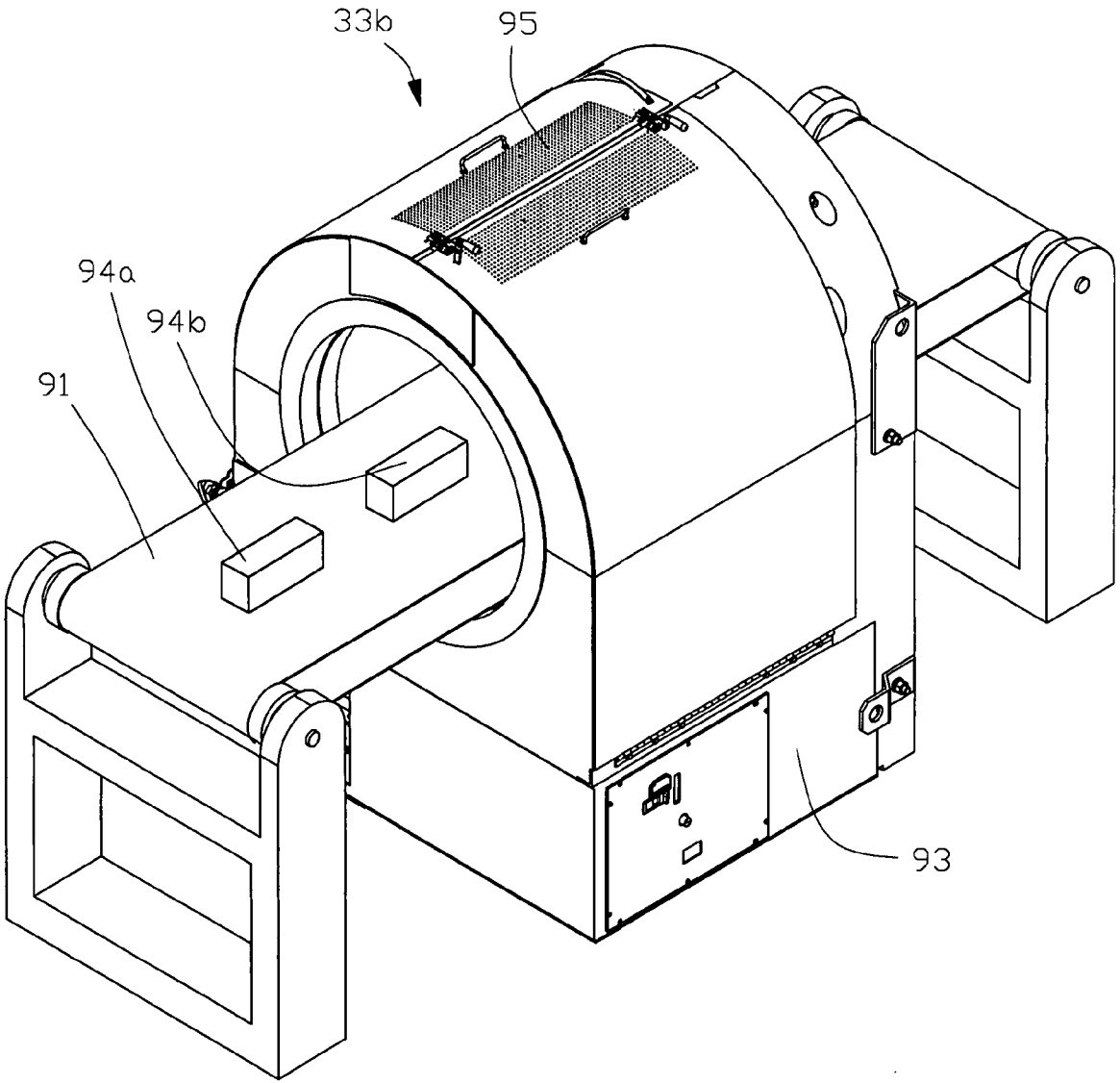
FIG. 8 is a perspective view of another induction tunnel heating system of the present invention for heating a workpiece.

FIG. 8 illustrates an alternative embodiment of a high-efficiency induction heating system 33*b* of the present invention wherein the tunnel furnace utilizes a conveyor means 91 to move workpieces 94*a* and 94*b* through the crucible of the tunnel furnace. Not shown in FIG. 8 within the enclosure of the tunnel furnace is crucible 30*a*, isolation sleeve 34*a* and coil 32*a*, which are generally arranged as illustrated in FIG. 7. Optionally a power supply or converter, similar to power converter 39, may be included in the enclosure of the tunnel furnace. The supply may, for example, be located in bottom section 93 of the enclosure. For this option, a forced airflow can be drawn into the bottom of the enclosure to first cool components of the power converter, and then directed upwards around the coil to cool the coil. The heated air exits the enclosure through openings 95 in its top.

Figure 9:
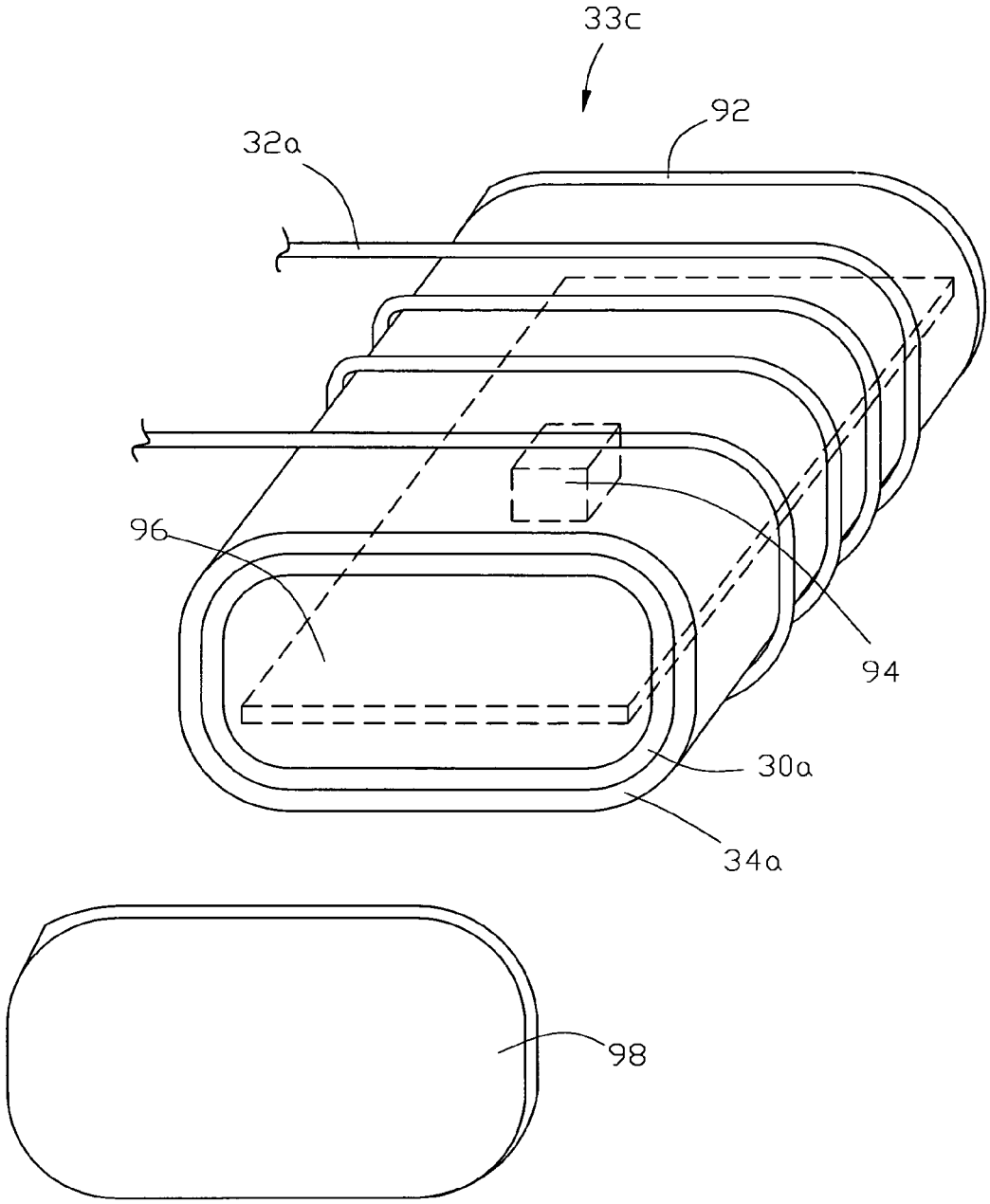
FIG. 9 is a perspective view of an enclosed induction heating system of the present invention for heating a workpiece.

In another alternative embodiment as shown in FIG. 9, a high-efficiency induction heating system 33*c* in accordance with the present invention, is in the form of an enclosed furnace in which one more discrete workpieces 94 can be heated. The crucible 30*a*, isolation sleeve 34*a* and coil 32*a* are similar to crucible 30, isolation sleeve 34 and coil 32 disclosed in other examples of the invention. Furnace first end structure 92 is attached to crucible 30*a* to form the first closed end of the furnace's closed heating chamber. Furnace second end structure 98 is removably attached to the opposing end of crucible 30*a*. The first and second end structures 92 and 98 are composed of a thermal insulating material, such as but not limited to, the disclosed material for the isolation sleeve. Suitable support means 96, such as a grating composed of a non-electrically conductive and high temperature withstand material, can be provided inside the heating chamber to support the workpieces. After insertion of the workpieces into the heating chamber, removably attached second end structure 98 is attached to the opposing end of crucible 30*a* to close the heating chamber. Ac current is supplied from a suitable source to coil 32*a*. The current generates a magnetic field in the coil that comprises a cable wound of a plurality of conductors isolated from each other that inductively heats crucible 30*a*. The heat generated in the crucible conducts into the enclosed heating chamber to heat workpiece 94 within the chamber.

Figure 10:
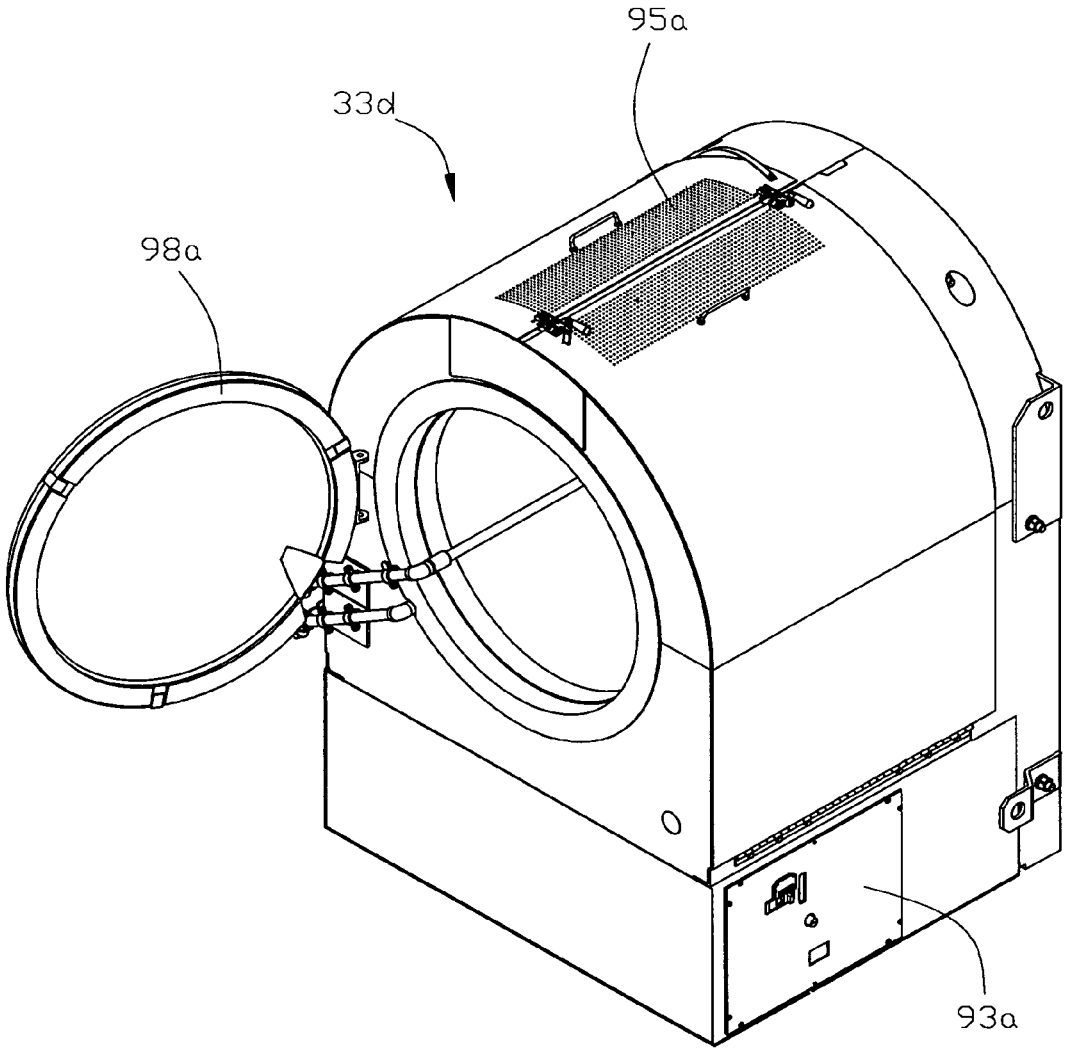
FIG. 10 is a perspective view of another enclosed induction heating system of the present invention for heating a workpiece.

FIG. 10 illustrates another arrangement of a high-efficiency induction heating system 33*d* of the present invention using a furnace with an enclosed heating chamber. Not shown in FIG. 10 and within the enclosure of the furnace, is crucible 30*a*, isolation sleeve 34*a*, furnace first end structure 92 and coil 32*a*, which are generally arranged as illustrated in FIG. 9. In the arrangement shown in FIG. 10, furnace second end structure 98*a* comprises a circular component that is attached by a hinged element to the enclosure. A power supply or converter, similar to power converter 39, may be optionally included in the enclosure of the furnace. The supply may, for example, be located in bottom section 93*a* of the enclosure. For this option, a forced airflow can be drawn into the bottom of the enclosure to first cool components of the power converter, and then directed upwards around the coil to cool the coil. The heat exits the enclosure through openings 95*a* in its top.

Figure 11A:
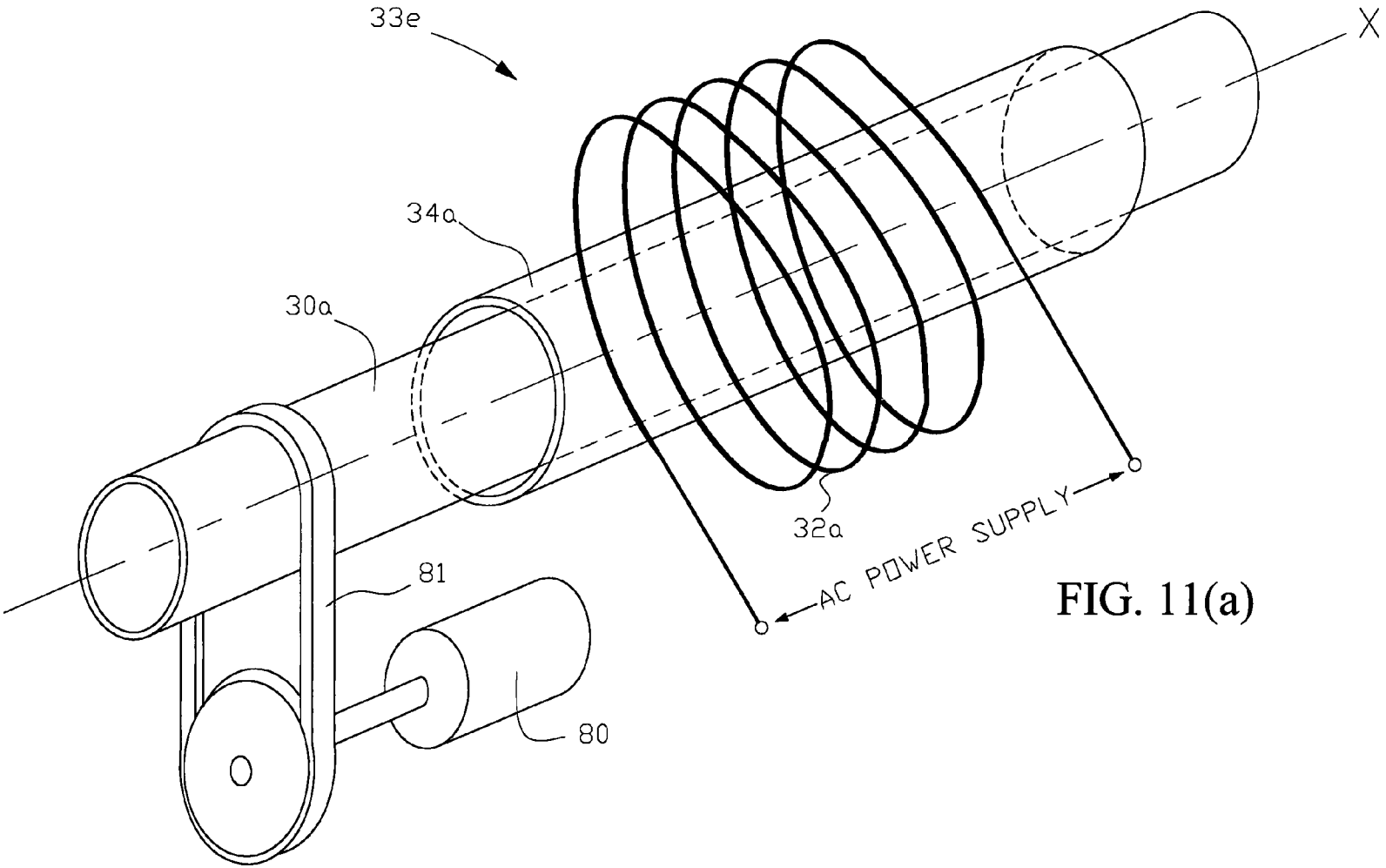
FIG. 11(*a*) is a perspective view of another induction tunnel heating system of the present invention.
Figure 11B:
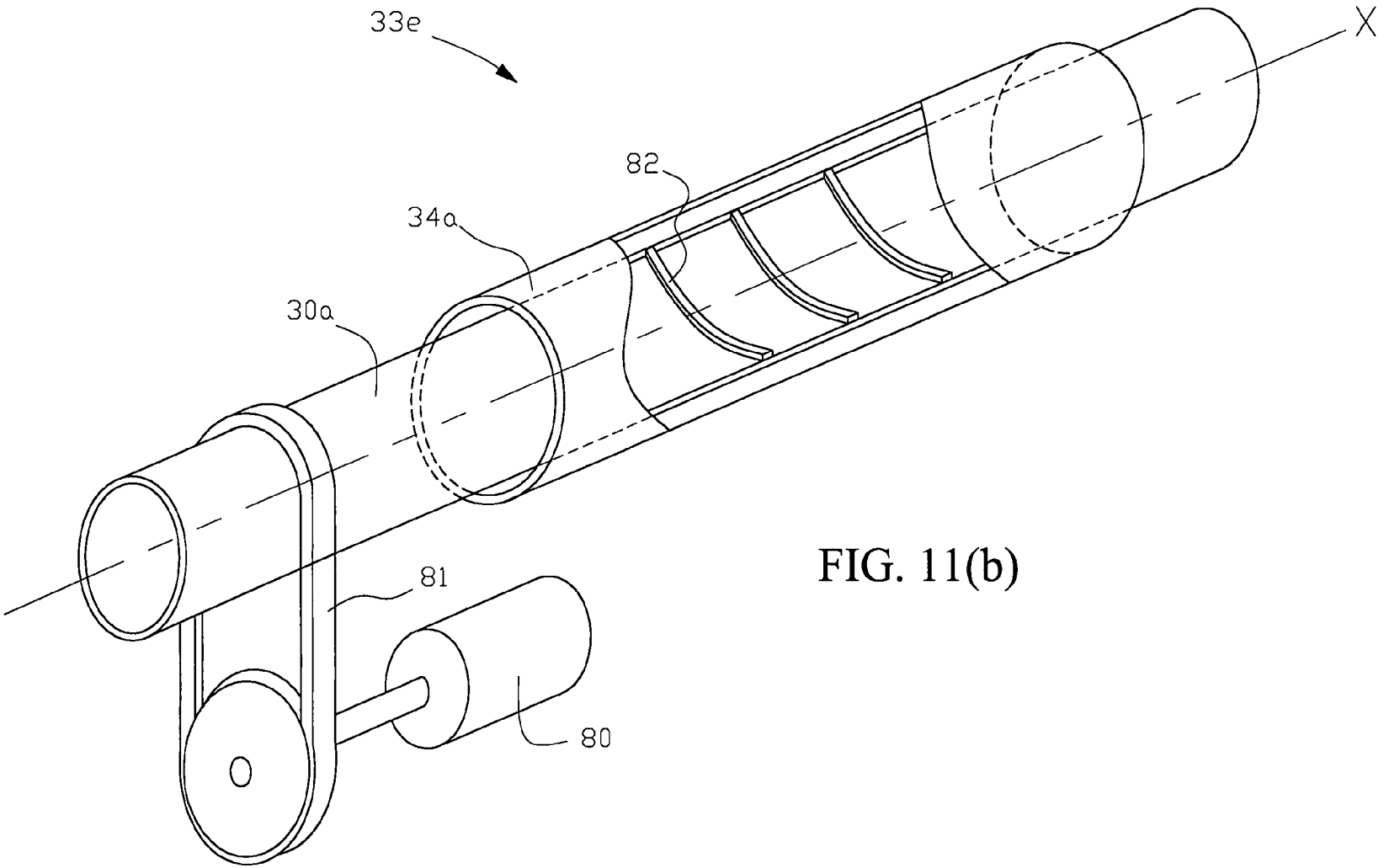
Figure 11C:
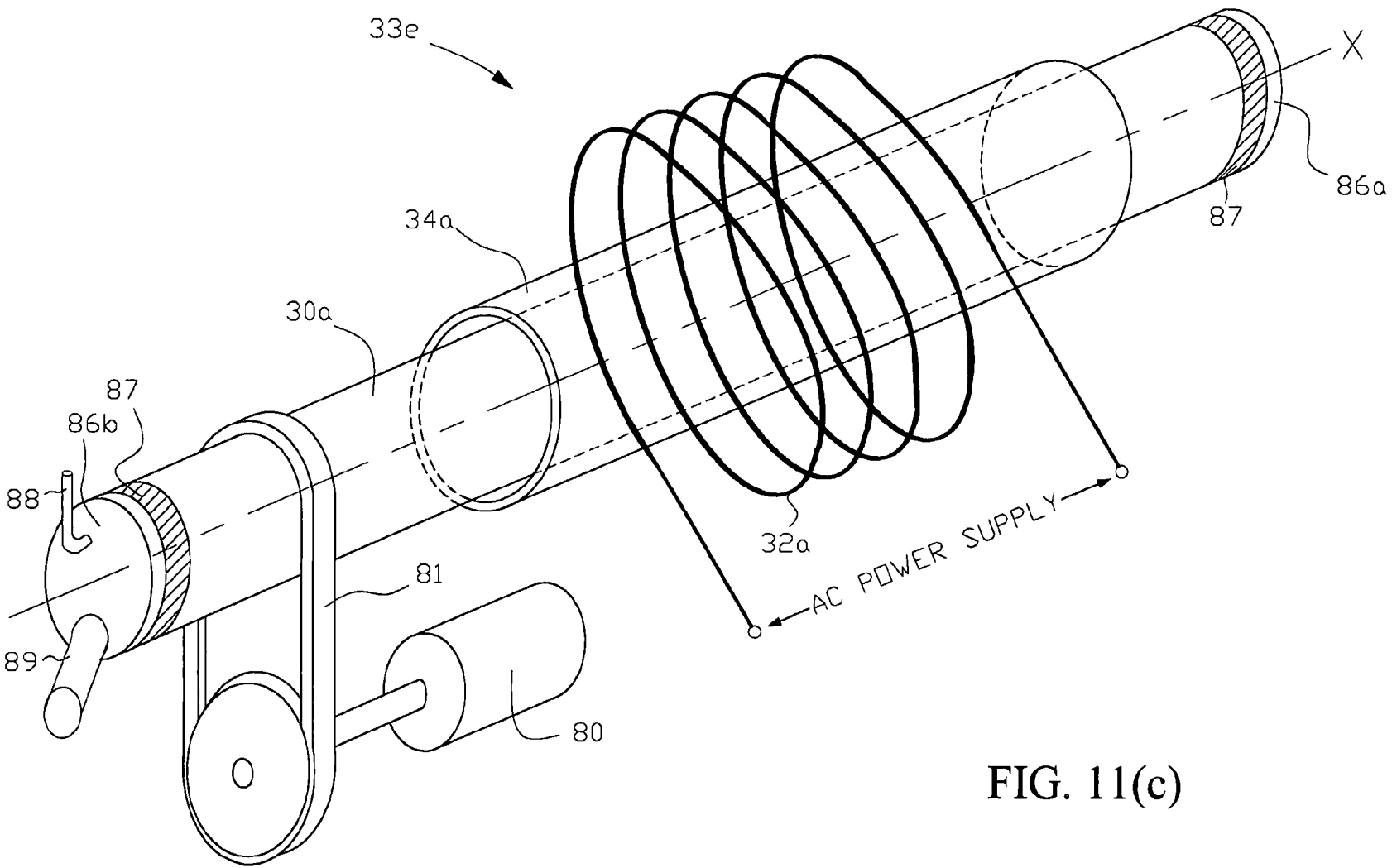

FIG. 11(*a*) illustrates another arrangement of a high-efficiency induction heating system 33*e* of the present invention wherein crucible 30*a* rotates about its longitudinal axis (X) by means of a suitable rotational drive such as, but not limited to, electric motor 80 with its output shaft suitably connected to a crucible rotating element. By way of example and not limitation, one method of connecting the rotational drive means to the crucible is shown in FIG. 11(*a*). The output shaft of electric motor 80 is connected to the outer perimeter of crucible 30*a* by belt 81. The crucible is tunnel-shaped and preferably cylindrical. Crucible 30*a*, isolation sleeve 34*a* and coil 32*a* are similar to crucible 30, isolation sleeve 34 and coil 32 disclosed in other examples of the invention. One or more workpieces or other material can be inserted into the crucible at either end of the crucible by means of a suitable external feed material conveyor means. As in other examples of the invention crucible 30*a* is heated by the magnetic field generated by current in coil 32*a*. The one or more workpieces or other material placed in the crucible are heated by the transfer of heat from the crucible.

In some examples of the invention isolation sleeve 34*a* may be attached to the crucible so that it rotates with the crucible. In those examples the coil is preferably separate from the isolation sleeve so that the coil does not rotate with the crucible.

In some examples of the invention the longitudinal axis of the crucible is substantially horizontally oriented so that the material in the crucible does not significantly advance along the longitudinal axis of the crucible as it is heated. In other examples of the invention the longitudinal axis of the crucible may be skewed relative to horizontal so that the material placed in one end of the crucible advances along the length of the crucible as the crucible rotates and the material is heated.

Optionally as shown in FIG. 11(*b*) (partial cross sectional view with coil 32*a* removed for clarity) a means for advancing the material through the crucible as the crucible rotates, such as one or more conveying elements 82 can be provided. Conveying element 82 provides a means for advancing one or more workpieces or material inside the crucible along the length of the crucible by forcing movement of the material along the crucible's longitudinal length or axis as the crucible rotates. The one or more conveying elements may consist of a continuous structural element or series of discrete structural elements rising from the interior wall of the crucible. By way of example and not limitation conveying elements may be a unitary or segmented helically wound protrusion(s) rising from the interior wall of the crucible. If crucible 30*a* is castably formed, the conveying elements may be cast integrally with the crucible. Otherwise the conveying elements may be discretely fitted on the interior wall. As the crucible rotates the material advances along the longitudinal length of the crucible by coming in contact with the one or more conveying means on the inner wall of the crucible. As the material advances along the longitudinal length of the crucible it is further heated until it reaches the exit end of the crucible.

In some applications the material being heated inside the crucible will have a tendency to adhere to the interior wall of the crucible as it is heated. In those applications induction heating system 33*e* can be provided with a means for vibrating the crucible to loosen any material sticking to its interior wall. The means for vibrating the crucible may be a weight fastened at one end of a flexible connecting element, such as a chain, that is fastened at its opposing end to the interior of crucible 30*a* so that as the crucible rotates, the weight periodically strikes the interior wall of the crucible by centrifugal motion about the chain length to vibrate the crucible and shake material from its interior wall. In other examples of the invention the means for vibrating the crucible may be accomplished by placing the crucible on flexible mounts and connecting a mechanical shaking device that either continuously or periodically shakes the crucible on the flexible mounts.

In some applications it may be desirable to seal the interior of the crucible from the external environment, for example, when the material in the crucible is heated to a temperature that creates a combination of gas and solid products that may be hazardous materials. For these applications of the invention, as diagrammatically shown in FIG. 11(*c*), end caps 86*a* and 86*b* seal the ends of crucible 30*a* from the external environment. Rotational seals 87 permit rotation of crucible 30*a* while end caps 86*a* and 86*b* remain fixed. Material can be fed into a sealed first end of the crucible, for example, at end cap 86*a* via an external material feed conveyor means. An air lock, or other means, may be provided to keep the interior of the crucible sealed from the external environment as material is fed into the crucible. If required gas products may be evacuated from the sealed interior of the crucible by exhaust port 88, which can include a one-way check valve to keep the interior of the crucible sealed from the external environment. If required solid products may be fed (typically but not by way of limitation by gravity) from the interior of the crucible at the exit end of the crucible by chute 89, which can employ an air lock to keep the interior of the crucible sealed from the external environment.

The high-efficiency induction heating systems shown in FIG. 11(*a*), FIG. 11(*b*) and FIG. 11(*c*) may be suitably housed in either of the enclosures illustrated in FIG. 8 or FIG. 10 with appropriate modifications as required to accommodate optional inclination of the crucible and/or opened or closed crucible ends. In these arrangements the high-efficiency induction heating systems shown in FIG. 11(*a*), FIG. 11(*b*) and FIG. 11(*c*) can include an integral power supply for coil 32*a* that is air-cooled as further disclosed above in previous examples of the invention. For these options, a forced airflow can be drawn into the bottom of the enclosure to first cool components of the power converter, and then directed upwards around the coil to cool the coil.

The terms "workpiece" or "material" as used herein are not intended to be limiting to any particular type of workpiece or material other than that the workpiece or material is capable of being heated primarily by radiation of heat from the inductively heated crucible, and also, for material in contact with the inner wall of the crucible, by conduction of heat from the inductively heated crucible.

The foregoing embodiments do not limit the scope of the disclosed invention. The scope of the disclosed invention is covered in the appended claims.

What is claimed is:

1. An induction heating system for heating a material, comprising:

a crucible forming a tunnel through which the material travels, the crucible formed substantially from the group of materials consisting of silicon carbides, high resistivity steels and high permeability steels;

an at least one induction coil comprising a cable wound of a plurality of conductors isolated from each other, the at least one induction coil surrounding the crucible;

an electrically and thermally insulating isolation sleeve of low magnetic permeance separating the crucible from the at least one induction coil; and a means for rotating the crucible.

2. The induction furnace of claim 1 wherein the isolation sleeve comprises a composite ceramic material.

3. The induction furnace of claim 2 wherein the composite ceramic material comprises an air-bubbled ceramic disposed between an at least one inner and an at least one outer layer of ceramic.

4. The induction furnace of claim 1 further comprising a power supply for providing ac power of a selected frequency to the at least one induction coil wherein the depth of penetration into the crucible of a magnetic field generated by a current of the selected frequency in the at least one induction coil is in the range of from half the thickness to the thickness of the crucible.

5. The induction furnace of claim 4 wherein the power supply is mounted adjacent to the at least one induction coil.

6. The induction furnace of claim 5 wherein an air flow sequentially cools the components of the power supply and the at least one induction coil.

7. The induction furnace of claim 1 further comprising a means for advancing the material through the tunnel of the crucible, the means for advancing the material through the tunnel disposed within the interior of the tunnel.

8. An induction heating system for heating a material, comprising:

a substantially enclosed crucible having a sealed first end opening whereby the material can be inserted into the crucible without allowing the interior atmosphere of the crucible to be released and a second sealed end opening whereby the material can be removed from the crucible without allowing the interior atmosphere of the crucible to be released, the crucible formed substantially from the group of materials consisting of silicon carbides, high resistivity steels and high permeability steels;

an at least one induction coil comprising a cable wound of a plurality of conductors isolated from each other, the at least one induction coil surrounding the crucible;

an electrically and thermally insulating isolation sleeve of low magnetic permeance separating the crucible from the at least one induction coil; and a means for rotating the crucible to advance the material along the longitudinal length of the crucible.

9. The induction furnace of claim 8 wherein the isolation sleeve comprises a composite ceramic material.

10. The induction furnace of claim 9 wherein the composite ceramic material comprises an air-bubbled ceramic disposed between an at least one inner and an at least one outer layer of ceramic.

11. The induction furnace of claim 8 further comprising a means for advancing the material through the tunnel of the crucible, the means for advancing the material through the tunnel disposed within the interior of the tunnel.

12. The induction furnace of claim 8 further comprising a power supply for providing ac power of a selected frequency to the at least one induction coil wherein the depth of penetration into the crucible of a magnetic field generated by a current of the selected frequency in the at least one induction coil is in the range of from half the thickness to the thickness of the crucible.

13. The induction furnace of claim 12 wherein the power supply is mounted adjacent to the at least one induction coil.

14. The induction furnace of claim 13 wherein an air flow sequentially cools the components of the power supply and the at least one induction coil.

15. A process for heating a material comprising the steps of:

feeding the material through a tunnel formed from a crucible, the crucible substantially comprising a material of high electrical resistivity or high magnetic permeability;

inductively heating the crucible by supplying a current to an at least one induction coil consisting of a cable wound of multiple conductors isolated from each other, the at least one induction coil surrounding the container and being electrically and thermally isolated from the container by an isolation sleeve;

adjusting the frequency of the current so that the depth of penetration into the crucible of the magnetic field generated by the current in the at least one induction coil is in the range of from half the thickness to the thickness of the container; and rotating the crucible, whereby the material is heated by the conduction of heat from the container to the metal.

16. The process of claim 15 wherein the container is formed substantially from a silicon carbide or a high permeability steel.

17. The process of claim 15 further comprising the steps of:

providing an ac power supply adjacent to the at least one induction coil to provide the current to the at least one induction coil; and supplying an air flow sequentially through the power supply and the at least one induction coil to cool the components in the power supply and the at least one induction coil.

18. A process for heating a material comprising the steps of:

sealing the interior of a crucible formed substantially from a material of high electrical resistivity or high magnetic permeability;

inductively heating the crucible by supplying a current to an at least one induction coil consisting of a cable wound of multiple conductors isolated from each other, the at least one induction coil surrounding the crucible and being electrically and thermally isolated from the crucible by an isolation sleeve;

adjusting the frequency of the current so that the depth of penetration into the crucible of the magnetic field generated by the current in the at least one induction coil is in the range of from half the thickness to the thickness of the crucible;

inserting the material into a first end of the crucible without allowing the interior atmosphere of the crucible to be released;

advancing the material through the crucible to heat the material by transfer of heat from the crucible;

removing the material from a second end of the crucible without allowing the interior atmosphere of the crucible to be released; and rotating the crucible, whereby the material is heated by the conduction of heat from the crucible to the material.

19. The method of claim 18 wherein the crucible is formed substantially from a silicon carbide or a high permeability steel.

20. The process of claim 18 further comprising the steps of:

providing an ac power supply adjacent to the at least one induction coil to provide the current to the at least one induction coil; and supplying an air flow sequentially through the power supply and the at least one induction coil to cool the components in the power supply and the at least one induction coil.

* * * * *